US005417879A

United States Patent [19]

Hall et al.

[11] Patent Number: 5,417,879

[45] Date of Patent: May 23, 1995

[54] SYNERGISTIC DUAL-SURFACTANT DETERGENT COMPOSITION CONTAINING SOPHOROSELIPID

[75] Inventors: Peter J. Hall, Vlaardingen; Johan Haverkamp, Bergschenhoek, both of Netherlands; Cornelis Van Kralingen, Chester, United Kingdom; Michael Schmidt, Schiedam, Netherlands

[73] Assignee: Lever Brothers Company, Division of Conopco, Inc., New York, N.Y.

[21] Appl. No.: 119,507

[22] Filed: Sep. 10, 1993

Related U.S. Application Data

[63] Continuation of Ser. No. 833,245, Feb. 10, 1992, abandoned.

[30] Foreign Application Priority Data

Feb. 12, 1991 [GB] United Kingdom ..... 9102945
Jan. 24, 1992 [GB] United Kingdom ..... 9201582

[51] Int. Cl.[6] ..... C11D 3/20

[52] U.S. Cl. ..... 252/174.17; 252/174.18; 252/DIG. 16; 252/DIG. 17; 536/123.3

[58] Field of Search ..... 536/123.13; 252/174.17, 252/DIG. 6, DIG. 14, 174.18

[56] References Cited

U.S. PATENT DOCUMENTS

| | | | |
|---|---|---|---|
| 4,216,311 | 8/1980 | Inoue et al. | 536/115 |
| 4,216,311 | 8/1980 | Inoue et al. | 536/115 |
| 4,276,094 | 6/1981 | Gutnick et al. | 252/356 |
| 4,297,340 | 10/1981 | Abe et al. | 424/70 |
| 4,305,929 | 12/1981 | Kawano et al. | 424/63 |
| 4,305,931 | 12/1981 | Kawano et al. | 424/69 |
| 4,309,447 | 1/1982 | Tsutsumi | 424/361 |
| 4,380,504 | 4/1983 | Gutnik et al. | 252/356 |
| 4,395,535 | 9/1983 | Gutnik et al. | 252/356 |
| 4,543,205 | 9/1985 | Contamin | 252/546 |
| 4,849,132 | 8/1989 | Fujita et al. | 252/356 |

FOREIGN PATENT DOCUMENTS

| | | | |
|---|---|---|---|
| 0423968 | 4/1991 | European Pat. Off. . | |
| 0550280 | 7/1993 | European Pat. Off. . | |
| 56-28296 | 3/1981 | Japan | 252/174.17 |
| 63-063389 | 3/1988 | Japan . | |
| 63-077535 | 4/1988 | Japan . | |
| 62-091236 | 4/1988 | Japan . | |
| 5137994 | 5/1993 | Japan . | |
| 9009451 | 8/1990 | WIPO | 252/174.17 |
| 9100331 | 1/1991 | WIPO | 252/174.17 |

OTHER PUBLICATIONS

Communication EP Search Report EP 92 30 1101.

*Primary Examiner*—Paul Lieberman
*Assistant Examiner*—Kery Fries
*Attorney, Agent, or Firm*—James J. Farrell

[57] ABSTRACT

A detergent composition contains a combination of two different surfactants, one micellar phase and one lamellar phase, at least one of the surfactants being a glycolipid biosurfactant. Preferred micellar phase biosurfactants are rhamnolipids, sophoroselipids and cellobioselipids, advantageously used in combination with non-glycolipid anionic or nonionic surfactants; while preferred lamellar biosurfactants are trehaloselipids, glucoselipids, and rhamnolipids, advantageously used in combination with micelar biosurfactants. The detergent compositions show enhanced oily soil detergency in fabric washing even when the glycolipid biosurfactants used individually are poor detergents.

9 Claims, No Drawings

SYNERGISTIC DUAL-SURFACTANT DETERGENT COMPOSITION CONTAINING SOPHOROSELIPID

This is a continuation application of Ser. No. 07/833,245 filed Feb. 10, 1992, now abandoned.

TECHNICAL FIELD

The present invention relates to detergent compositions, particularly to compositions used for washing fabrics, dishes and household surfaces. The compositions of the invention, which are especially but not exclusively suitable for fabric washing, contain one or more glycolipid biosurfactants.

BACKGROUND AND PRIOR ART

Detergent compositions traditionally contain one or more detergent active material in addition to various other ingredients such as detergency builders, bleaches, fluorescers, perfumes etc. Notable applications of detergent compositions are to clean fabrics, usually by washing portable fabric items in a bowl or in a washing machine, to clean crockery and cooking utensils, again by washing in a bowl (hand dishwashing), and to clean hard surfaces such as glass, glazed surfaces, plastics, metals and enamels.

A number of classes of surfactant materials have been used, some for many years, as detergent active materials, including anionic and nonionic materials.

Glycolipid biosurfactants, which are described in more detail below, include rhamnolipids, sophoroselipids, glucoselipids, cellobioselipids and trehaloselipids. Glycolipid biosurfactants can be produced by either bacterial or yeast fermentation. This is inherently advantageous in that products of fermentation can generally be derived from renewable raw materials and are likely to be biodegradable after use.

JP 63 077 535A (Toyo Beauty) discloses an emulsion composition containing alpha-decenoic bonded rhamnolipid or its salt as emulsifying agent. The emulsion is said to be useful for cosmetics, health-care products, medicines, toiletries, detergents and foods.

DE 3 526 417A (Wella) discloses a cosmetic agent containing sophoroselipid lactone used to combat dandruff and as a bacteriostatic agent in deodorants.

U.S. Pat. No. 4,216,311 (Kao) discloses the production of a glycolipid methyl ester from sophoroselipid. These glycolipid methyl esters are useful as a base or improving additive for various cleansers and fats and oils products and for use in painting and printing processes, fibre processing, metal processing, stationery, cosmetics, drugs, agricultural chemicals, luster prevention, synthetic resins, paper manufacturing, machinery, leather and the like.

Our copending British Patent Application No 91 02945.4 filed 12 Feb. 1991, from which the present application claims priority, describes and claims the use of combinations of rhamnolipids with other surfactants in detergent compositions.

We have now found that glycolipid biosurfactants can give a synergistic enhancement of oily/fatty soil detergency when used in certain combinations with each other, or jointly with other surfactant(s). Enhanced detergency has been observed even with glycolipids that exhibit poor detergency when used alone.

DEFINITION OF THE INVENTION

The present invention accordingly provides a detergent composition comprising (i) a first surfactant which is a micellar phase surfactant, and (ii) a second surfactant which is a lamellar phase surfactant, wherein at least one of said first and second surfactants is a glycolipid biosurfactant.

The invention also provides a method of washing which comprises contacting fabrics, or an inanimate surface to be cleaned, with a composition according to the previous paragraph, or a wash liquor obtainable by adding the composition to water, notably in an amount ranging from 0.5 to 50 grams of compositions per litre of water.

DETAILED DESCRIPTION OF THE INVENTION

The detergent composition of the invention contains at least two different surfactants having different characteristics, at least one of which must be a glycolipid biosurfactant.

The two classes of surfactant are referred to herein as micellar phase and lamellar phase surfactants respectively. These terms relate to the phase in which the surfactants are likely to be present under typical wash conditions.

The two types of surfactant may be distinguished by the behaviour of a 1% by weight aqueous solution in demineralised water at pH 7.0 and 25° C. A surfactant solution containing dispersed lamellar phases exhibits birefringent textures when viewed under a polarising optical microscope, while a micellar solution does not.

In general, a micellar phase surfactant will provide a clear solution when present at a concentration of 1% by weight in demineralised water at pH 7.0 and 25° C., although the presence of small amounts of impurities may reduce the clarity. A lamellar phase surfactant will always provide a cloudy solution when present at a concentration of 1% by weight in demineralised water at pH 7.0 and 25° C.

At least one of the surfactants must be chosen from a specific class of surfactant, the glycolipid biosurfactants; while the other may or may not also be a glycolipid biosurfactant. Thus some glycolipids are micellar phase surfactants and others are lamellar phase surfactants.

Glycolipid surfactants with which the present invention are concerned include rhamnolipids, glucoselipids, sophoroselipids, trehaloselipids, cellobioselipids and mixtures thereof. Within any one class of glycolipids, some materials may be micellar and others lamellar.

Micellar phase glycolipid biosurfactants may suitably be selected from rhamnolipids, glucoselipids, sophoroselipids, cellobioselipids and mixtures thereof.

Lamellar phase glycolipid biosurfactants may suitably be selected from rhamnolipids, glucoselipids, trehaloselipids and mixtures thereof.

The surfactants (i) and (ii) may both be glycolipids. The micellar phase glycolipid is then most preferably a rhamnolipid, a sophoroselipid or a cellobiose lipid, while the lamellar phase glycolipid is most preferably a trehaloselipid, a glucoselipid or a rhamnolipid.

Alternatively one of the surfactants (i) and (ii) may be a non-glycolipid surfactant, preferably an anionic or nonionic surfactant. Zwitterionic and cationic surfactants are not preferred, and if present it is desirable that they are at low levels, such as not more than 10% by weight of all surfactant present.

Preferred anionic and nonionic surfactants are listed below.

The weight ratio of the first surfactant (i) to the second surfactant (ii) is preferably in the range from 20:1 to 1:20, and may lie in a narrower range, for example from 10:1 to 1:10, more preferably 4:1 to 1:4.

The Glycolipid Biosurfactant

Specific biosurfactants include rhamnolipids, glucoselipids, sophoroselipids, trehaloselipids, cellobioselipids and mixtures thereof. Each will now be described in more detail below:

Rhamnolipids

These biosurfactants have the formula (I):

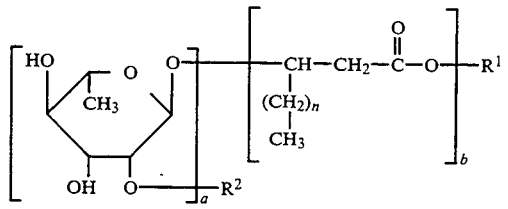

(I)

where a is 1 or 2; b is 1 or 2, n is 4 to 10. preferably 6; $R^1$ is H or a cation, preferably H, or a monovalent solubilising cation, $R^2$ is H or the group

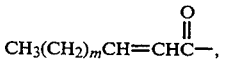

preferably H; m is 4 to 10; and the values of m and n need not be the same at each occurrence.

Rhamnolipids can be produced by bacterial fermentation. This is inherently advantageous in that products of bacterial fermentation can generally be derived from renewable raw materials and are likely to be biodegradable after use. Another advantage of the surfactants of formula (I) is that they can be produced as a by-product of enzyme manufacture.

Rhamnolipids can be produced by bacteria of the genus Pseudomonas. The bacterial fermentation typically utilises as substrates a sugar or glycerol or an alkane or mixtures thereof.

Appropriate fermentation methods are reviewed in D. Haferburg, R. Hommel, R. Claus and H. P. Kleber in *Adv Biochem. Eng./Biotechnol.* (1986) 33, 53–90 and by F. Wagner, H. Bock and A. Kretschmar in Fermentation (ed. R. M. Lafferty) (1981), 181–192, Springer Verlag, Vienna.

Any sample of rhamnolipid will generally contain a variety of individual compounds within the general formula (I). The proportions of individual compounds is governed by the microorganism species, and the particular strain employed for fermentation, the substrate materials supplied to the fermentation, and other fermentation conditions.

The bacterial fermentation generally produces compounds in which $R^1$ is hydrogen or a solubilising cation. Such compounds can undergo conversion between the salt and the acid forms in aqueous solution, according to the pH of the solution. Common solubilising cations are alkali metal, ammonium and alkanolamine.

Glucoselipids

A second class of glycolipid biosurfactant in accordance with the present invention comprises glucoselipids of the formula (II).

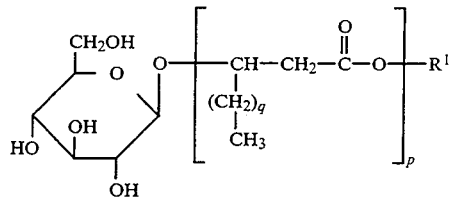

(II)

where $R^1$ is H or a cation; p is 1 to 4; and q is 4 to 10, preferably 6.

Glucoselipids can be produced by the bacterium *Alcaligenes Sp.MM*1. Appropriate fermentation methods are reviewed by M. Schmidt in his PhD thesis (1990), Technical University of Braunschweig, and by Schulz et al (1991) Z. Naturforsch 46C 197–203. The glucoselipids are recovered from the fermentation broth via solvent extraction using ethyl ether or a mixture of either dichloromethane:methanol or chloroform:methanol.

Sophoroselipids

A third class of glycolipid biosurfactant in accordance with the present invention comprises sophoroselipids of the formula (III)

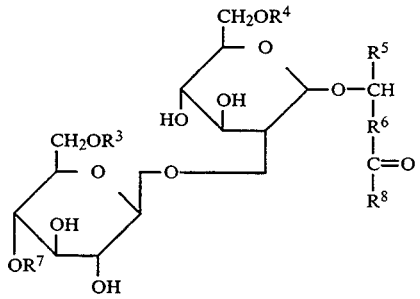

(III)

where $R^3$ and $R^4$ are individually H or an acetyl group; $R^5$ is a saturated or unsaturated, hydroxylated or non-hydroxylated hydrocarbon group having 1 to 9 carbon atoms, preferably being a methyl group; $R^6$ is a saturated or unsaturated hydroxylated or non-hydroxylated hydrocarbon group having 1 to 19 carbon atoms; with the proviso that the total number of carbon atoms in the groups $R^5$ and $R^6$ does not exceed 20 and is preferably from 14 to 18.

The sophoroselipid may be incorporated into detergent compositions of the present invention as either the open chain free acid form, where $R^7$ is H and $R^8$ is OH, or in its lactone form, where a lactone ring is formed between $R^7$ and $R^8$ as shown by formula (IV).

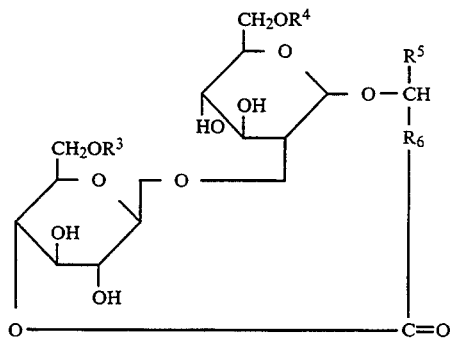

(IV)

where $R^3$, $R^4$ and $R^6$ are as defined above; with the proviso that at least one of $R^3$ and $R^4$ is an acetyl group.

Sophoroselipids can be produced by yeast cells, for example *Torulopsis apicola* and *Torulopsis bombicola*. The fermentation process typically utilises sugars and alkanes as substrates. Appropriate fermentation methods are reviewed in A. P. Tulloch, J. F. T. Spencer and P. A. J. Gorin, Can. J Chem (1962) 40 1326 and U. Gobbert, S. Lang and F. Wagner, Biotechnology Letters (1984) 6 (4), 225. The resultant product is a mixture of various open-chain sophoroselipids and sophoroselipid lactones, which may be utilised as a mixtures, or the required form can be isolated. When the glycolipid biosurfactant comprises sophoroselipids, the weight ratio of sophoroselipids to additional surfactant is preferably in the range 4:1 to 3:2 and is more preferably 4:1.

Trehaloselipids

A fourth class of glycolipid biosurfactant in accordance with the present invention comprises trehaloselipids of the general formula (V).

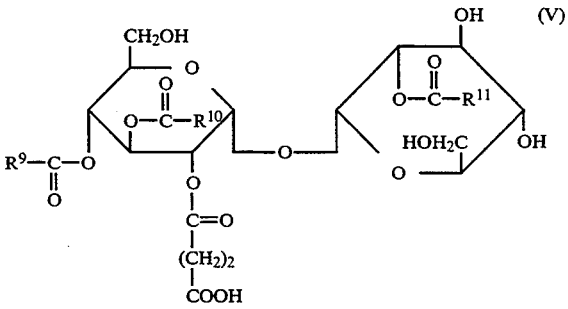

(V)

where $R^9$, $R^{10}$ and $R^{11}$ are individually a saturated or unsaturated, hydroxylated or non-hydroxylated hydrocarbon of 5 to 13 carbon atoms.

Trehaloselipids can be produced by bacteria fermentation using the marine bacterium *Arthrobacter sp. Ek* 1 or the fresh water bacterium *Rhodococcus erythropolis*. Appropriate fermentation methods are provided by Ishigami et al (1987) J. Jpn Oil Chem Soc 36 847–851, Schultz et al (1991), Z. Naturforsch 46C 197–203; and Passeri et al (1991) Z. Naturforsch 46C 204–209.

Cellobioselipids

A fifth class of glycolipid biosurfactant in accordance with the present invention comprises cellobioselipids of the general formula (VI).

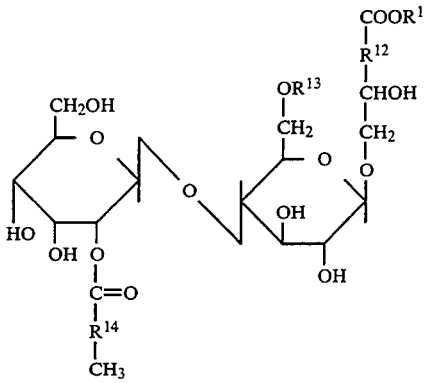

(VI)

where $R^1$ is H or a cation; $R^{12}$ is a saturated or non-saturated, hydroxylated or non-hydroxylated hydrocarbon having 9 to 15 carbon atoms, preferably 13 carbon atoms; $R^{13}$ is H or an acetyl group; $R^{14}$ is a saturated or non-saturated, hydroxylated or non-hydroxylated hydrocarbon having 4 to 16 carbon atoms.

Cellobioselipids can be produced by fungi cells from the genus ustilago. Appropriate fermentation methods are provided by Frautz, Lang and Wagner (1986) Biotech Letts 8 757–762.

When the glycolipid biosurfactant comprises cellobioselipids the weight ratio of cellobioselipids to additional surfactant is preferably in the range 4:1 to 2:3.

Non-glycolipid Surfactants

As indicated previously, the detergent composition of the invention may optionally contains at least non-glycolipid surfactant in addition to the glycolipid biosurfactant(s) described above, provided that at least one micellar phase surfactant and at least one lamellar phase surfactant are present. Preferably, the glycolipid biosurfactant is micellar phase and the non-glycolipid surfactant is lamellar phase.

The non-glycolipid surfactant can be chosen from anionic surfactants, nonionic surfactants, zwitterionic surfactants, cationic surfactants; but if zwitterionic or cationic surfactants are present, it is desirable that they are incorporated at low levels, such as not more than 10% by weight of all surfactant present.

Anionic Surfactants

Examples of suitable anionic surfactants that may be used are alkyl benzene sulphonates, alkyl ether sulphates, otefin sulphonates, alkyl sulphonates, secondary alkyl sulphonates, fatty acid ester sulphonates, dialkyl sulphosuccinates, alkyl orthoxylene sulphonates and other disclosed in the literature, especially 'Surface Active Agents' Vol. 1, by Schwartz & Perry, Interscience 1949 and 'Surface Active Agents' Vol. II by Schwartz, Perry & Berch (Interscience 1958), in the current edition of "McCutcheon's Emulsifiers & Detergents" published by the McCutcheon division of Manufacturing Confectioners Company or in 'Tensid-Taschenbuch' H. Stache, 2nd Edn, Carl Hanser Verlag, München & Wien, 1981.

Specific examples of alkyl benzene sulphonates include alkali metal, ammonium or alkanolamine salts of alkylbenzene sulphonates having from 10 to 18 carbon atoms in the alkyl group.

Suitable alkyl and alkylether sulphates include those having from 10 to 24 carbon atoms in the alkyl group, the alkylether sulphates have from 1 to 5 ethylene oxide groups.

Suitable olefin sulphonates are those prepared by sulphonation of $C_{10}$–$C_{24}$ alpha-olefins and subsequent neutralisation and hydrolysis of the sulphonation reaction product.

Specific examples of alkyl sulphates, or sulphated fatty alcohol salts, include those of mixed alkyl chain length, in which the ratio of $C_{12}$ alkyl chains to $C_{18}$ alkyl chains is in the range of from 9:4 to 1:6. A suitable material can be obtained from a mixture of synthetic lauryl and oleyl alcohols in appropriate properties.

Specific examples of fatty acid ester sulphonates include those of the general formula

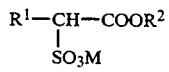

wherein $R^1$ is derived from tallow, palm or coconut oil and $R^2$ is a short chain alkyl group such as butyl.

Specific examples of dialkyl sulphosuccinates include those in which both alkyl substituent contains at least 4 carbon atoms, and together contain 12 to 20 carbon atoms in total, such as di-$C_8$ alkyl sulphosuccinate.

Specific examples of alkyl orthoxylene sulphonates include those in which the alkyl group contains from 12 to 24 carbon atoms.

Other anionic surfactants which may be used include alkali metal soaps of a fatty acid, preferably one containing 12 to 18 carbon atoms. Typical such acids are oleic acid, ricinoleic acid and fatty acids derived from caster oil, rapeseed oil, groundnut oil, coconut oil, palmkernal oil or mixtures thereof. The sodium or potassium soaps of these acids can be used. As well as fulfilling the role of surfactants, soaps can act as detergency builders or fabric conditioners.

Dialkyl sulphosuccinates are of especial interest as lamellar phase anionic surfactants for use in the present invention.

Nonionic Surfactants

Nonionic detergent compounds which may be used are alkyl ($C_{6-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylenediamine. Other so-called nonionic detergent compounds include long-chain tertiary amine oxides, alkyl sulphoxides $C_{10}$–$C_{14}$ alkyl pyrollidones and tertiary phosphine oxides.

Suitable lamellar phase nonionic surfactants include those with an HLB value below 10.5, preferably below 10 and more preferably in a range of from 8.5 to 9.5. For ethoxylated nonionic surfactants the HLB value is defined as one fifth of the mole per cent of ethylene oxide in the molecule.

Suitable nonionic surfactants may be ethoxylated materials, especially ethoxylated aliphatic alcohols, with a relatively low proportion of ethoxylation so as to give an HLB value below 10.5.

It may be desirable, however, that any ethylene oxide content of the nonionic surfactant be <5% by weight of the surfactant system, or zero, and various non-ethoxylated nonionic surfactants are also suitable for use in the present invention.

These include alkyl polyglycosides of general formula $$R^{15}O(R^{16}O)_t(G)_y \text{ or } R^{15}\overset{O}{C}O(R^{16}O)_t(G)_y$$

in which $R^{15}$ is an organic hydrophobic residue containing 10 to 20 carbon atoms, $R^{16}$ contains 2 to 4 carbon atoms, G is a saccharide residue containing 5 to 6 carbon atoms, t is in the range 0 to 25 and y is in the range from 1 to 10.

The hydrophobic group $R^{15}$ is preferably alkyl, alkenyl, hydroxyalkyl or hydroxyalkenyl. However, it may include an aryl group for example alkyl-aryl, alkenyl-aryl and hydroxyalkyl-aryl. Particularly preferred is that R is alkyl or alkenyl of 10 to 16 carbon atoms, more particularly 12 to 14 carbon atoms.

The value of t in the general formula above is preferably zero, so that the $—(R^{16}O)_t—$ unit of the general formula is absent.

If t is non-zero it is preferred that $R^{16}O$ is an ethylene oxide residue. Other likely possibilities are propylene oxide and glycerol residues. If the parameter t is non-zero so that $R^{16}O$ is present, the value of t (which may be an average value) will preferably lie in the range from 0.5 to 10.

The group G is typically derived from fructose glucose, mannose, galactose, talose, gulose, allose, altrose, idose, arabinose, xylose, lyxose and/or ribose. Preferably, the G is provided substantially exclusively by glucose units. Intersaccharide bonds may be from a 1-position to a 2, 3, 4 or 6-position of the adjoining saccharide. Hydroxyl groups on sugar residues may be submitted, e.g. etherified with short alkyl chains of 1 to 4 carbon atoms.

The value which y, which is an average, desirably lies between 1 and 4, especially 1 and 2.

Alkyl polyglycosides of formula $R^{15}O(G)_y$, i.e. a formula as given above in which t is zero, are available from Horizon Chemical Co.

0-alkanoyl glucosides are described in International Patent Application WO 88/10147 (Novo Industri A/S). In particular the surfactants described therein are glucose esters with the acyl group attached in the 3- or 6-position such as 3-0-acyl-D-glucose or 6-0-acyl-D-glucose. In the present invention we prefer to use a 6-0-alkanoyl glucoside, especially compounds having the formula:

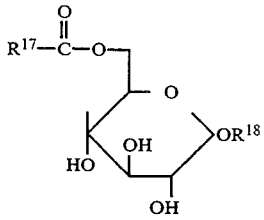

wherein $R^{17}$ is an alkyl or alkenyl group having from 7 to 19 preferably 11 to 19 carbon atoms, and $R^{18}$ is hydrogen or an alkyl group having from 1 to 4 carbon atoms.

Most preferred are such compounds where $R^{18}$ is an alkyl group, such as ethyl or isopropyl. Alkylation in the 1- position enables such compounds to be prepared by regiospecific enzymatic synthesis as described by Bjorkling et al. (J.Chem. Soc., Chem. Common. 1989 p934) the disclosure of which is incorporated herein by reference.

While esters of glucose are contemplated especially, it is envisaged that corresponding materials based on other reduced sugars, such as galactose and mannose are also suitable.

Further possible nonionic surfactants are monoglyceryl ethers or esters of the respective formulae

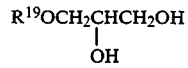

and

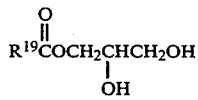

$R^{19}$ is preferably a saturated or unsaturated aliphatic residue. In particular $R^{19}$ may be linear or branched alkyl or alkenyl. More preferably, $R^{19}$ is a substantially linear alkyl or alkenyl moiety having from 9 to 16 carbon atoms, notably a $C_8$–$C_{12}$ alkyl moiety. Most preferably, $R^{19}$ is decyl, undecyl or dodecyl.

The monoglyceryl ethers of alkanols are known materials and can be prepared, for example by the condensation of a higher alkanol and glycidol. Glycerol monoesters are of course well know and available from various suppliers including Alkyril Chemicals Inc.

Another class of nonionic surfactants of interest for use in the present invention is comprised by 1,2-diols of the general formula

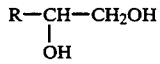

where R is a saturated or unsaturated hydrocarbon group containing from 8 to 16 carbon atoms.

Amounts and Proportions of Surfactants

Compositions of this invention will generally contain a surfactant mixture comprising micellar phase surfactant (i) and lamellar phase surfactant(s) (ii) in an amount which is from 1 to 60% by weight of the composition; preferably from 2 to 45%; more preferably from 5 to 40%; most preferably from 5 to 35%.

The amount of glycolipid biosurfactant present is preferably at least 2% by weight, more preferably at least 5%, of the overall composition.

The weight ratio range which gives enhanced detergency will vary depending on the specific surfactants used and can be determined by experiment. In general the proportion of glycolipid biosurfactant should be low when its alkyl chains are shorter, but higher if its alkyl chains are longer.

The weight ratio of micellar phase surfactant to lamellar phase surfactant will generally lie within a range of 20:1 to 1:20 and may lie in a narrower range, e.g. from 10:1 to 1:10; more preferably 4:1 to 1:4.

The proportions of the surfactants are desirably such as to give better oily soil detergency than given by the (or either) glycolipid biosurfactant alone, the total amount of surfactant being the same.

If a non-glycolipid biosurfactant is present, the proportions are desirably such as to give better oily soil detergency that that given by the non-glycolipid surfactant alone, the total amount of surfactant being the same.

Detergency builders

If the composition of the invention is intended for fabric washing, it will generally contain one or more detergency builders, suitably in an amount of from 5 to 80% by weight, preferably from 7 to 70% by weight, more preferably from 20 to 80% by weight. If it is in solid form, the composition is likely to contain at least 10 or 15% of builder. This may be any material capable of reducing the level of free calcium ions in the wash liquor and will preferably provide the compositions with other beneficial properties such as the generation of an alkaline pH and the suspension of soil removed from the fabric.

Preferred builders include alkali metal (preferably sodium) aluminosilicates, which may suitably be incorporated in amounts of from 5 to 60% by weight (anhydrous basis) of the composition, and may be either crystalline or amorphous or mixtures thereof, having the general formula:

$$0.8\text{–}1.5\ Na_2O{\cdot}Al_2O_3{\cdot}0.8\text{–}6\ SiO_2$$

These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof. Also of interest is the novel zeolite P described and claimed in EP 384070 (Unilever).

Phosphate-built detergent compositions are also within the scope of the invention. Examples of phosphorus-containing inorganic detergency builders include the water-soluble salts, especially alkali metal pyrophosphates, orthophosphates, polyphosphates and phosphonates. Specific examples of inorganic phosphate builders include sodium and potassium tripolyphosphates, ortho phosphates and hexametaphosphates.

However, preferred detergent compositions of the invention preferably do not contain more than 5% by weight of inorganic phosphate builders, and are desirably substantially free of phosphate builders.

Other builders may also be included in the detergent composition of the invention if necessary or desired: suitable organic or inorganic water-soluble or water-insoluble builders will readily suggest themselves to the skilled detergent formulator. Inorganic builders that may be present include alkali metal (generally sodium) carbonate; while organic builders include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates; and organic precipitant builders such as alkyl- and alkenylmalonates and succinates, and sulphonated fatty acid salts.

Especially preferred supplementary builders are polycarboxylate polymers, more especially polyacrylates and acrylic/maleic copolymers, suitably used in amounts of from 0.5 to 15% by weight, especially from 1 to 10% by weight; and monomeric polycarboxylates, more especially citric acid and its salts, suitably used in amounts of from 3 to 20% by weight, more preferably from 5 to 15% by weight.

Other Inqredients

It is desirable that fabric washing compositions according to the invention be approximately neutral or at least slightly alkaline, that is when the composition is dissolved in an amount to give surfactant concentration of 1 g/l in distilled water at 25° C. the pH should desirably be at least 7.5. For solid compositions the pH will usually be greater, such as at least 9. To achieve the required pH, the compositions may include a water-soluble alkaline salt. This salt may be a detergency builder (as described above) or a non-building alkaline material.

The compositions of the invention may contain an electrolyte, for instance present in such an amount to give a concentration of at least 0.01 molar, when the composition is added to water at a concentration of 1 g/litre. Electrolyte concentration may possibly be higher such as at least 0.05 or 0.1 molar especially if the composition is of solid form: liquid compositions generally limit electrolyte for the sake of stability. 1 g/litre is approximately the lowest level at which detergent compositions for fabric washing are used in usual practice. More usual is usage at a level of 4 to 50 g/litre. The amount of electrolyte may be such as to achieve an electrolyte concentration of 0.01 molar, most preferably at least 0.1 molar, when the composition is added to water at a concentration of 4 g/litre.

Further ingredients which can optionally be employed in the detergent composition of the invention include polymers containing carboxylic or sulphonic acid groups in acid form or wholly or partially neutralised to sodium or potassium salts, the sodium salts being preferred.

Preferred polymers are homopolymers and copolymers of acrylic acid and/or maleic acid or maleic anhydride. Of especial interest are polyacrylates, polyalphahydroxy acrylates, acrylic/maleic acid copolymers, and acrylic phosphinates. Other polymers which are especially preferred for use in liquid detergent compositions are deflocculating polymers such as for example disclosed in EP 346995.

The molecular weights of homopolymers and copolymers are generally 1000 to 150,000, preferably 1500 to 100,000. The amount of any polymer may lie in the range from 0.5 to 5% by weight of the composition. Other suitable polymeric materials are cellulose ethers such as carboxy methyl cellulose, methyl cellulose, hydroxy alkyl celluloses, and mixed ethers, such as methyl hydroxy ethyl cellulose, methyl hydroxy propyl cellulose, and methyl carboxy methyl cellulose. Mixtures of different cellulose ethers, particularly mixtures of carboxy methyl cellulose and methyl cellulose, are suitable. Polyethylene glycol of molecular weight from 400 to 50,000, preferably from 1000 to 10,000, and copolymers of polyethylene oxide with polypropylene oxide are suitable as also are copolymers of polyacrylate with polyethylene glycol. Polyvinyl pyrrolidone of molecular weight of 10,000 to 60,000, preferably of 30,000 to 50,000 and copolymers of polyvinyl pyrrolidone with other poly pyrrolidones are suitable. Polyacrylic phosphinates and related copolymers of molecular weight 1000 to 100,000, in particular 3000 to 30,000, are also suitable.

It may also be desirable to include in the detergent composition of the invention an amount of an alkali metal silicate, particularly sodium ortho-, meta- or preferably neutral or alkaline silicate. The presence of such alkali metal silicates at levels, for example, of 0.1 to 10% by weight, may be advantageous in providing protection against the corrosion of metal parts in washing machines, besides providing some measure of building and giving processing benefits.

Further examples of other ingredients which may be present in the composition include fabric softening agents such as fatty amines, fabric softening clay materials, lather boosters such as alkanolamides, particularly the monoethanolamides derived from palm kernel fatty acids and coconut fatty acids; lather depressants; oxygen-releasing bleaching agents such as sodium perborate and sodium percarbonate; peracid bleach precursors; chlorine-releasing bleaching agents such as trichloroisocyanuric acid; heavy metal sequestrants such as EDTA; fluorescent agents; perfumes including deodorant pefumes; enzymes such as cellulases, proteases, lipases and amylases; germicides; pigments, colourants or coloured speckles; and inorganic salts such as sodium and magnesium sulphate. Sodium sulphate may if desired be present as a filler material in amounts up to 40% by weight of the composition; however, as little as 10% or less by weight of the composition of sodium sulphate, or even none at all, may be present.

The detergent compositions according to the invention may be in any suitable form including powders, bars, liquids and pastes. For example suitable liquid compositions may be non-aqueous or aqueous, the latter being either isotropic or lamellar structured. The compositions may be prepared by a number of different methods according to their physical form. In the case of granular products they may be prepared by dry-mixing, coagglomeration, spray-drying from an aqueous slurry or any combination of these methods. One preferred physical form is a granule incorporating a detergency builder salt. This may be prepared by conventional granulation techniques or spray-drying.

EXAMPLES

The following non-limiting examples illustrate the invention. Parts and percentages are by weight unless otherwise stated.

Rhamnolipids

EXAMPLE 1

This example used as the micellar phase surfactant (i) a rhamnolipid produced as a by-product during fermentation using *Pseudomonas glumae* with glucose and glycerol as substrates. Partial characterisation of the dried material obtained from the fermentation showed that it contained one or more compounds of formula I above, in which the value of n was 10. The lamellar phase surfactant (ii) was an ethoxylated aliphatic alcohol.

Aqueous wash liquors were prepared containing the following materials in deionised water:

| | |
|---|---|
| Rhamnolipid (as dried material from the fermentation)<br>Ethoxylated dodecyl alcohol with | 1 g/liter |

-continued

| | |
|---|---|
| average 3 ethylene oxide residues | |
| Sodium metaborate | 0.05 molar |

These quantities would be typical of using 6 g/litre of a particular detergent product containing 16.7% by weight surfactant.

The wash liquor had pH about 10.7 resulting from the presence of the metaborate.

Wash liquors were prepared with various ratios of the two surfactants and used to wash polyester test cloths soiled with radiolabelled triolein. Washing was carried out at 40° C. for 20 minutes in a Tergotometer.

The removal of triolein was determined using radiotracer techniques and the results are set out in Table 1.

TABLE 1

| Rhamnolipid weight % of active material | C12E3 weight % of active material | % Triolein Removal |
|---|---|---|
| 100 | 0 | 28 |
| 80 | 20 | 42 |
| 60 | 40 | 63 |
| 40 | 60 | 73 |
| 20 | 80 | 72 |
| 0 | 100 | 1 |

Clearly all the mixtures of the rhamnolipid and the ethoxylate nonionic surfactant gave better detergency than either surfactant alone.

EXAMPLE 2

Example 1 was repeated, replacing the ethoxylate nonionic surfactant with an anionic surfactant, di-$C_8$ alkyl sulphosuccinate, as the lamellar surfactant (ii). The results are set out in Table 2.

TABLE 2

| Rhamnolipid weight % of active material | di-$C_8$ Sulphosuccinate of active material | % Triolein Removal |
|---|---|---|
| 100 | 0 | 28 |
| 80 | 20 | 30 |
| 60 | 40 | 38 |
| 40 | 60 | 45 |
| 20 | 80 | 46 |
| 0 | 100 | 35 |

EXAMPLE 3

Example 1 was repeated, using as the micellar surfactant (i) a rhamnolipid available under the designation BioEm-LKP (trade mark) from Petrogen Inc, Illinois. It was a mixture of compounds of formula I above in which n=6 and b=2, $R^1$=H, $R^2$=H. Compounds with a=1 and a=2 were present in approximately equal weight ratio.

Results are set out in Table 3, which shows a very considerable synergistic effect.

TABLE 3

| Petrogen Rhamnolipid weight % of active material | C12E3 weight % of active | Triolein Removal |
|---|---|---|
| 100 | 0 | 4.59 |
| 80 | 20 | 4.20 |
| 60 | 40 | 36.51 |
| 40 | 60 | 55.78 |
| 20 | 80 | 43.01 |
| 0 | 100 | 1.55 |

EXAMPLES 4–10

The Test System

Detergency performance of biosurfactants was studied using the test fabrics described in Table 4 and test conditions described below.

TABLE 4

| | | |
|---|---|---|
| Test cloth: | EMPA 104 | WFK20D |
| Supplier: | EMPA St-Gallen | Wschereiforschung Krefeld |
| Test cloth type: | Polyester/Cotton | Polyester/Cotton |
| Soil composition: | 50 ml Indian Ink<br>100 ml Olive Oil<br>850 ml Water | 1.72 g/l Kaolin<br>0.16 g/l Carbon<br>0.08 g/l Iron oxide (black)<br>0.04 g/l Iron oxide (yellow)<br>14.00 g/l Sebum sprayed on the cloth as $CCl_4$ solution |
| Reflectance of unwashed test cloth: | 14.7 Reflectance Units | 42.6 Reflectance Units |

Wash Liquors

Aqueous wash liquors were prepared containing the following materials in deionised water:

| | |
|---|---|
| glycolipid biosurfactant(s) as dried material from the fermentation)<br>any non-glycolipid surfactant | 0.5 g/liter |
| sodium metaborate | 0.05 molar |

The wash liquor had a pH of about 10 resulting from the presence of metaborate.

Test Conditions

The tests were performed in 100 ml polyethylene bottles with 30 ml/bottle wash liquor, 1 piece of 6×6 cm text cloth and 1 piece of 6×6 cm white (clean) cotton as a redeposition cloth. The cloth:liquor ratio/-bottle was 1:30. A maximum of 50 of these bottles were agitated for 30 minutes in a Miele TMT washing machine at 40° C. Afterwards, the washed test fabrics were rinsed 3 times with cold water before drying.

Monitoring Method

Detergency performance was assessed by calculating the increase in reflectance at 460 nm (with incident light <400 nm filtered out) (delta R460*). [Delta R=reflectance of the washed cloth ($R_w$)−the reflectance of the unwashed cloth ($R_i$).]

EXAMPLE 4

Different rhamnolipid samples (micelar phase) were tested in combination with the nonionic surfactant $C_{12}EO_3$ (ethoxylated dodecyl alcohol having an average of 3 ethylene oxide residues) (lamellar phase) in the described wash liquor. The rhamnolipid RL-BNS was produced by bacteria of the genus *Pseudomonas glumae* which consists of pure rhamnolipid of formula I where a=2, b=2, n=10, $R^1$=H, $R^2$=H. BioEm-LKP (trade mark) (Petrogen Inc, Illinois) is a mixture of rhamnolipids from Pseudomonas as described in Example 2. Results are shown in Table 5.

TABLE 5

| Rhamnolipid weight % of active mixture | delta R(460)* | | | |
|---|---|---|---|---|
| | BioEm-LKP | | RL-BNS | |
| | EMPA 104 | WFK20D | EMPA 104 | WFK20D |
| 100 | 5.8 | 10.7 | 4.2 | 12.8 |
| 80 | 17.2 | 14.4 | 10.8 | 14.9 |
| 60 | 17.7 | 19.8 | 14.7 | 16.5 |
| 40 | 14.1 | 20.9 | 10.2 | 19.5 |
| 20 | 10.4 | 16.8 | 5.7 | 17.7 |
| 0 | 6.2 | 14.2 | 6.8 | 15.3 |

Sophoroselipids

EXAMPLE 5

The sophoroselipids SOL-TUBS (micelar phase) was tested in combination with several lamellar phase surfactants in the described wash liquor. Cosurfactants tested were Synperonic A3, $C_{12}$-1,2-diol and $C_{10}$-mono-glycerolether. Results are shown in Table 6.

SOL-TUBS is a sophoroselipid from Technical University of Braunschweig, Germany. It is produced by the yeast strain *Torulopsis bombicola*. It consists of a mixture of four sophoroselipids of formula (III) and (IV) with at least 80% being the 1',4''-lactone-6',6''-diacetate lipid where in formula (IV) $R^3$ & $R^4$ acetyl groups; $R^5$=1 and $R^6$=15. As described by the literature in JAOCS 65 (9) (1990) 1460, the main fatty acid chain length in SOL-TUBS is $C_{18}$ (ie, in formula (IV) $R^5+R^6=C_{16}$).

TABLE 6

| Sophoroselipid (SOL-TUBS) weight % of active mixture | Delta R(460)* Additional Surfactant | | | | | |
|---|---|---|---|---|---|---|
| | Synperonic A3 | | $C_{12}$-1,2-diol | | $C_{10}$-mono-glycerolether | |
| | EMPA104 | WFK20D | EMPA104 | WFK20D | EMPA104 | WFK20D |
| 100 | 19.3 | 17.0 | 19.3 | 17.0 | 19.3 | 17.0 |
| 80 | 24.2 | 26.0 | 22.7 | 19.8 | 23.0 | 23.6 |
| 60 | 22.8 | 22.8 | 9.1 | 14.6 | 23.6 | 22.3 |
| 40 | n.d. | 19.2 | 3.7 | 12.2 | 20.8 | 16.8 |
| 20 | 17.6 | 15.1 | 2.7 | 10.3 | 9.1 | 12.5 |
| 0 | 11.0 | 14.0 | 0.4 | 10.1 | 3.8 | 9.6 |

n.d. = not determined

EXAMPLE 6

The sophoroselipid SOL-CH (micelar phase) was tested as described in Example 5. Results are shown in Table 7.

SOL-CH is a sophoroselipid produced .by the yeast strain *Torulopsis bombicola*. It consists of a mixture of at least 8 sophoroselipids of formula (III) and (IV).

TABLE 7

| Sophoroselipid (SOL-CH) weight % of active mixture | Delta R(460)* Additional Surfactant | | | | | |
|---|---|---|---|---|---|---|
| | Synperonic A3 | | $C_{12}$-1,2-diol | | $C_{10}$-mono-glycerolether | |
| | EMPA104 | WFK20D | EMPA104 | WFK20D | EMPA104 | WFK20D |
| 100 | 18.2 | 16.3 | 18.2 | 16.3 | 18.2 | 16.3 |
| 80 | 23.3 | 19.4 | 21.7 | 20.0 | 21.2 | 19.2 |
| 60 | 27.3 | 21.3 | 12.3 | 14.9 | 20.8 | 23.1 |
| 40 | 26.6 | 19.0 | 2.6 | 12.0 | 20.1 | 19.3 |
| 20 | 21.5 | 15.1 | 1.4 | 9.9 | 9.24 | 16.3 |
| 0 | 12.9 | 13.1 | 1.8 | 8.5 | 4.3 | 12.3 |

EXAMPLE 7

The sophoroselipid (SOL-COO−) (micelar phase) was tested as described in Example 5. Results are shown in Table 8.

SOL-COO− is a sophoroselipid produced by the yeast strain *Torulopsis bombicola* and is partially hydrolysed, ie has the structure (III) where $R^3$ and $R^4$ are H; $R^5$ is 1; $R^6$ is 15; $R^7$ is H and $R^8$ is OH.

TABLE 8

| Sophoroselipid (SOL-COO—) weight % of active mixture | Delta R(460)* Additional Surfactant | | | | | |
|---|---|---|---|---|---|---|
| | Synperonic A3 | | $C_{12}$-1,2-diol | | $C_{10}$-mono-glycerolether | |
| | EMPA104 | WFK20D | EMPA104 | WFK20D | EMPA104 | WFK20D |
| 100 | 12.4 | 9.8 | 12.4 | 9.8 | 12.4 | 9.8 |
| 80 | 16.5 | 17.6 | 13.4 | 13.8 | 22.7 | 15.17 |
| 60 | 22.7 | 17.9 | 8.7 | 11.5 | 22.5 | 14.7 |
| 40 | 21.2 | 16.3 | 5.9 | 9.9 | 16.3 | 12.3 |
| 20 | 19.2 | 14.6 | 4.3 | 9.0 | 9.4 | 11.2 |
| 0 | 16.6 | 11.1 | 2.3 | 7.3 | 6.0 | 9.9 |

Cellobioselipids

EXAMPLE 8

Cellobioselipids (CELL-TUBS) (micelar phase), which are produced by fungi of the strain *Ustilago maydis* were tested in combination with several lamellar phase surfactants in the described wash liquor. Cosurfactants tested were Synperonic A3, $C_{12}$-1,2-dio and $C_{10}$-mono-glycerolether. Results are shown in Table 9.

CBL-TUBS consists of approximately 4 cellobioselipids of formula (IV). In the main component $R^1$ is H; $R^{12}$ is 15; $R^{13}$ is acetyl; $R^{14}$ is 4.

TABLE 9

| Cellobioselipid (CBL-TUBS) weight % of active mixture | Delta R(460)* Additional Surfactant | | | | | |
|---|---|---|---|---|---|---|
| | Synperonic A3 | | $C_{12}$-1,2-diol | | $C_{10}$-mono-glycerolether | |
| | EMPA104 | WFK20D | EMPA104 | WFK20D | EMPA104 | WFK20D |
| 100 | 2.3 | 6.7 | 2.3 | 6.7 | 2.3 | 6.7 |
| 80 | 17.6 | 12.7 | 7.1 | 10.5 | 13.5 | 8.9 |
| 60 | 20.6 | 16.5 | 5.74 | 10.6 | 13.0 | 11.0 |
| 40 | n.d. | 16.1 | 5.1 | 9.2 | 12.0 | 12.3 |
| 20 | 17.6 | 15.0 | 2.9 | 8.6 | 6.4 | 10.7 |
| 0 | 11.7 | 12.1 | 2.5 | 8.9 | 5.2 | 11.4 |

n.d. = not determined

EXAMPLE 9

Cellobioselipids as described in Example 8 were partially hydrolysed such that in Formula (VI) $R^1$=H, $R^{13}$=H; $R^{12}$ is 15; $R^{13}$ is H; also the ester-linked fatty acid group containing $R^{14}$ is absent. These cellobioselipids (micelar phase) were studied with different lamellar phase cosurfactants as described in Example 8. Results are shown in Table 10.

TABLE 10

| Cellobioselipid (CBL-COO—) weight % of active mixture | Delta R(460)* Additional Surfactant | | | | | |
|---|---|---|---|---|---|---|
| | Synperonic A3 | | $C_{12}$-1,2-diol | | $C_{10}$-mono-glycerolether | |
| | EMPA104 | WFK20D | EMPA104 | WFK20D | EMPA104 | WFK20D |
| 100 | 17.9 | 15.4 | 15.7 | 13.3 | 15.7 | 13.4 |
| 80 | 19.2 | 15.3 | 13.0 | 11.2 | 16.2 | 11.8 |
| 60 | 20.6 | 13.0 | 4.0 | 8.9 | 15.9 | 11.0 |
| 40 | 17.9 | 12.1 | 0.8 | 5.8 | 9.7 | 9.7 |
| 20 | 14.6 | 10.7 | 0.9 | 4.4 | 6.4 | 6.8 |
| 0 | 14.1 | 7.6 | 0.0 | 3.4 | 5.2 | 5.1 |

EXAMPLE 10

Trehaloselipid (THL-4) (lamellar phase) was tested in combination with rhamnolipid BioEm-LKP as described in Example 2 (micelar phase).

The trehaloselipid THL-4 was produced by the bacterium *Arthrobacter sp. Ek*1 and consists of trehaloselipid of formula (V) in which $R^9$, $R^{10}$, $R^{11}$ have an average of 7–9 carbon atoms.

Results are shown in Table 11.

TABLE 11

| Trehaloselipid weight % of active mixture | Rhamnolipid weight % of active mixture | Delta R(460)* | |
|---|---|---|---|
| | | EMPA 104 | WFK 20D |
| 100 | 100 | 5.8 | 9.8 |
| 80 | 80 | 8.9 | 10.7 |
| 60 | 60 | 10.9 | 13.6 |
| 40 | 40 | 7.2 | 14.8 |
| 20 | 20 | 8.2 | 12.9 |
| 0 | 0 | 4.5 | 9.5 |

EXAMPLES 11 TO 12

The test system

Detergency performance of biosurfactants was studied using the test fabric WFK 20D as described in Table 4, and test conditions described below.

Wash Liquors

Aqueous wash liquors were prepared containing the following materials in deionised water:

glycolipid biosurfactant(s) (as dried material from the fermentation)

any non-glycolipid surfactant detergent base powder as shown in Table 12.

Total surfactant concentration was 0.5 g/litre. The detergent base powder was incorporated at 2.5 g/litre. Test conditions and monitoring methods were as described for Examples 4 to 10.

TABLE 12

| Detergent Base Powder | Parts |
|---|---|
| Zeolite 4A (anhydrous basis) | 27.62 |
| Maleic/acrylic acid copolymer | 4.15 |
| Sodium carbonate | 10.15 |
| Alkaline silicate | 0.46 |
| Sodium carboxymethylcellulose | 0.81 |
| Fluorescer | 0.22 |
| Moisture plus salts | 12.85 |

EXAMPLE 12

The sophoroselipids SOL-TUBS as described in Example 5 (micelar phase) was tested in combination with Synperonic A3 (lamellar phase). Results are shown in Table 13.

TABLE 13

| Sophoroselipid Weight % of Active Mixture | Delta R(460)* |
|---|---|
| 100 | 14.4 |
| 80 | 18.1 |
| 60 | 20.3 |
| 40 | 16.8 |
| 20 | 14.2 |
| 0 | 14.3 |

EXAMPLE 12

The cellobioselipid CBL-TUBS as described in Example 8 (micelar phase) was tested in combination with Synperonic A3 (lamellar phase). Results are shown in Table 14.

TABLE 14

| Cellobioselipid Weight % of Active Mixture | Delta R(460)* |
|---|---|
| 100 | 14.5 |
| 80 | 16.9 |
| 60 | 18.2 |
| 40 | 17.2 |
| 20 | 16.2 |
| 0 | 14.3 |

We claim:

1. A detergent composition suitable for washing fabrics, comprising (i) a first surfactant which is a (sophoroselipid) sophorose lipid surfactant, and is of the formula (III)

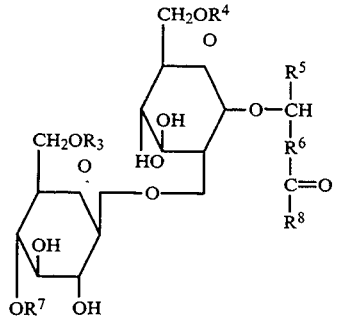

(III)

where $R^3$ and $R^4$ are individually H or an acetyl group; $R^5$ is a saturated or unsaturated, hydroxylated or non-hydroxylated hydrocarbon group having 1 to 9 carbon atoms, and $R^6$ is a saturated or unsaturated, hydroxylated or non-hydroxylated hydrocarbon group having 1 to 19 carbon atoms with the proviso that the total number of carbon atoms in the groups $R^5$ and $R^6$ does not exceed 20; $R^7$ is H or a lactone ring formed with $R^8$; $R^8$ is OH or a lactone ring formed with $R^7$ and (ii) a second surfactant which is a lamellar phase surfactant selected from the group consisting of non-glycolipid anionic and nonionic surfactants and glycolipid surfactants, in amounts that are sufficient to synergistically enhance oily/fatty soil detergency.

2. A detergent composition according to claim 1, wherein the sophoroselipid has the formula (IV)

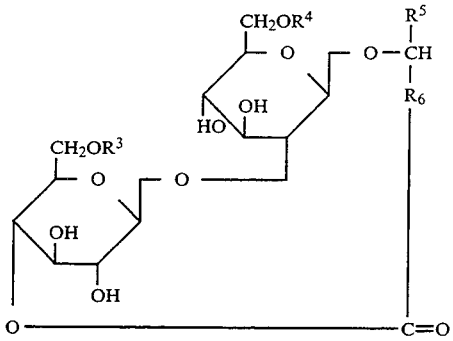

(IV)

where $R^3$, $R^4$, $R^5$ and $R^6$ are as defined in claim 7 with the proviso that at least one of $R^3$ and $R^4$ is an acetyl group.

3. A detergent composition according to claim 1, wherein $R^5$ is methyl.

4. A detergent composition according to claim 1 wherein the total number of carbon atoms of those pads of the sophoroselipid that are represented by $R^5$ and $R^6$ is from 14 to 18.

5. A detergent composition according to claim 1, wherein the weight ratio of the first surfactant to the second surfactant is within the range of from 20:1 to 1:20.

6. A detergent composition according to claim 5, wherein the weight ratio of the first surfactant to the second surfactant is within the range of from 10:1 to 1:10.

7. A detergent composition according to claim 5, wherein the weight ratio of the first surfactant to the second surfactant is within the range of from 4:1 to 1:4.

8. A detergent composition according to claim 1, wherein the amount of sophorose lipid biosurfactant present is at least 2% by weight.

9. A detergent composition according to claim 1 comprising 1 to 60% by weight in total of the first surfactant and the second surfacant and from 5 to 80% by weight of detergency builder.

* * * * *